US010125775B2

(12) United States Patent
Yano et al.

(10) Patent No.: US 10,125,775 B2
(45) Date of Patent: Nov. 13, 2018

(54) MOTOR-DRIVEN COMPRESSOR

(71) Applicant: KABUSHIKI KAISHA TOYOTA JIDOSHOKKI, Kariya-shi, Aichi-ken (JP)

(72) Inventors: Junya Yano, Kariya (JP); Akio Fujii, Kariya (JP); Junichi Takahata, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 363 days.

(21) Appl. No.: 14/312,880

(22) Filed: Jun. 24, 2014

(65) Prior Publication Data

US 2014/0377097 A1 Dec. 25, 2014

(30) Foreign Application Priority Data

Jun. 25, 2013 (JP) ..... 2013-132616

(51) Int. Cl.
*F04D 25/06* (2006.01)
*F04B 39/06* (2006.01)
(Continued)

(52) U.S. Cl.
CPC ..... *F04D 25/06* (2013.01); *F01C 21/10* (2013.01); *F04B 39/06* (2013.01); *F04B 39/121* (2013.01);
(Continued)

(58) Field of Classification Search
CPC . F04D 25/0693; H02K 11/33; F04C 18/0215; F04C 23/008; F04B 35/04; F04B 27/0873; F04B 39/121
(Continued)

(56) References Cited

U.S. PATENT DOCUMENTS 5,865,413 A * 2/1999 Niemann ..... H05K 3/301 248/314
6,619,933 B2 * 9/2003 Ikeda ..... F04B 39/06 417/410.1
(Continued)

FOREIGN PATENT DOCUMENTS

CN 102684379 A 9/2012
JP 2004-044555 A 2/2004
(Continued)

OTHER PUBLICATIONS

Communication dated Oct. 27, 2014 from the European Patent Office in counterpart application No. 14173414.5.
(Continued)

*Primary Examiner* — Charles Freay
*Assistant Examiner* — Lilya Pekarskaya
(74) *Attorney, Agent, or Firm* — Sughrue Mion, PLLC

(57) ABSTRACT

A motor-driven compressor that includes a compression unit adapted to compress refrigerant, an electric motor adapted to drive the compression unit, and a housing that accommodates the compression unit and the electric motor. The housing includes a coupling member. A motor driving circuit is adapted to drive the electric motor. The motor driving circuit includes a circuit board and a capacitor, which is electrically connected to the circuit board. The capacitor includes a side surface and an end surface that faces the coupling member. A resin material is located between the coupling member and the capacitor. The coupling member includes a facing surface that faces the capacitor. The facing surface includes a recess extending away from the capacitor. The recess receives some of the resin material.

11 Claims, 3 Drawing Sheets

(51) Int. Cl.

| | |
|---|---|
| ***F04B 39/12*** | (2006.01) |
| ***F04B 49/06*** | (2006.01) |
| ***F01C 21/10*** | (2006.01) |
| ***F04C 23/00*** | (2006.01) |
| *F04C 18/344* | (2006.01) |

(52) U.S. Cl.
CPC ..... *F04B 49/06* (2013.01); *F04C 23/008* (2013.01); *F04C 18/344* (2013.01); *F04C 2240/403* (2013.01); *F04C 2240/808* (2013.01)

(58) Field of Classification Search
USPC ..... 417/410.1; 310/68 R, 44
See application file for complete search history.

(56) References Cited

U.S. PATENT DOCUMENTS

| | | | | |
|---|---|---|---|---|
| 7,972,123 | B2 * | 7/2011 | Koide | F04B 27/0873 417/411 |
| 8,149,589 | B2 * | 4/2012 | Chan | H01G 2/106 257/723 |
| 8,451,611 | B2 | 5/2013 | Nakagami et al. | |
| 2004/0052660 | A1 | 3/2004 | Kimura et al. | |
| 2011/0189035 | A1 * | 8/2011 | Nakagami | F04B 39/06 417/410.5 |
| 2012/0235531 | A1 | 9/2012 | Fukasaku et al. | |
| 2013/0021753 | A1 | 1/2013 | Enami et al. | |

FOREIGN PATENT DOCUMENTS

| | | | |
|---|---|---|---|
| JP | 2007-263061 | A | 10/2007 |
| JP | 2009-257102 | A | 11/2009 |
| JP | 2010-116790 | A | 5/2010 |
| JP | 2010-148296 | A | 7/2010 |
| JP | 2014-020321 | A | 2/2014 |

OTHER PUBLICATIONS

Communication dated Dec. 30, 2015, issued by the State Intellectual Property Office of the P.R.C. in corresponding Chinese Application No. 201410283640.8.

* cited by examiner

MOTOR-DRIVEN COMPRESSOR

BACKGROUND OF THE INVENTION

The present invention relates to a motor-driven compressor that includes a compression unit, which compresses refrigerant, an electric motor, which drives the compression unit, and a motor driving circuit, which drives the electric motor.

Japanese Laid-Open Patent Publication No. 2007-263061 describes an example of a motor-driven compressor. The motor-driven compressor includes a motor driving circuit, which includes a planar circuit board and various types of electric components. The electric components, which are electrically connected to the circuit board, include a switching element and a plurality of capacitors, for example. The capacitors are coupled to a coupling member (coupling base) that forms a portion of the housing. A resin material is arranged between the capacitors and the coupling member to prevent separation of the capacitors from the coupling base when the vehicle vibrates.

The capacitors are coupled to the coupling base to which the resin material is applied in advance. If a relatively large amount of resin material is applied in advance to the coupling member, some of the resin material may be forced out from between the capacitors and the coupling member and adhere to the leads of capacitors and other electric components, for example. The adhered resin material may cause a defect such as current leakage.

It is an object of the present disclosure to provide a motor-driven compressor that limits transfer of a resin material out of the space between capacitors and a coupling member.

To achieve the above object, one aspect of the present invention is a motor-driven compressor that includes a compression unit adapted to compress refrigerant, an electric motor adapted to drive the compression unit, and a housing that accommodates the compression unit and the electric motor. The housing includes a coupling member. A motor driving circuit is adapted to drive the electric motor. The motor driving circuit includes a circuit board and a capacitor, which is electrically connected to the circuit board. The capacitor includes a side surface and an end surface that faces the coupling member. A resin material is located between the coupling member and the capacitor. The coupling member includes a facing surface that faces the capacitor. The facing surface includes a recess extending away from the capacitor. The recess receives some of the resin material.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

Figure 1:
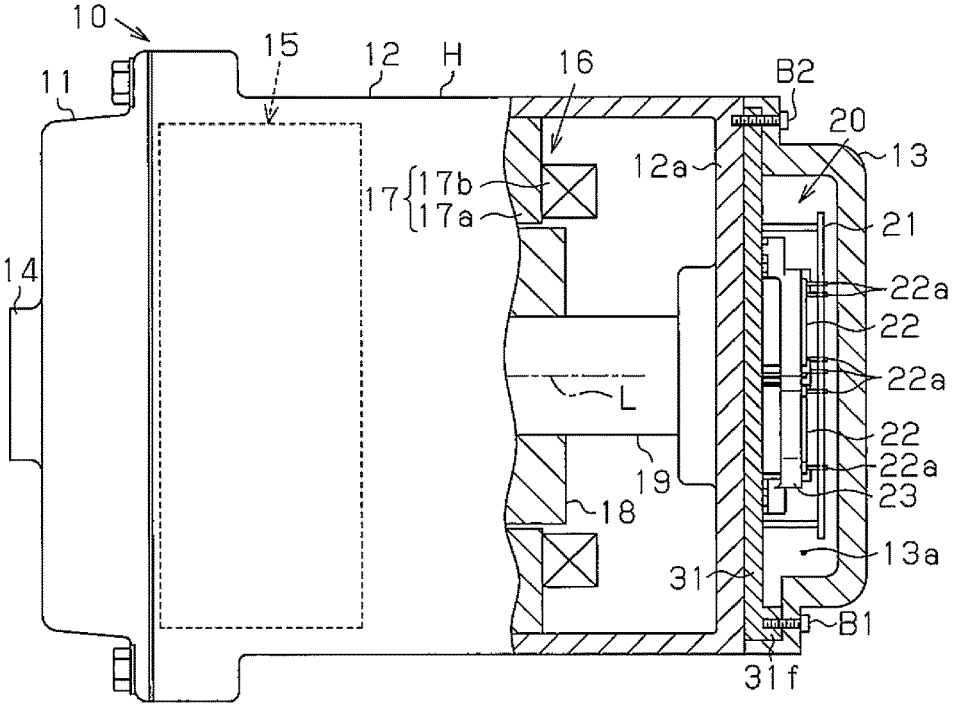
FIG. 1 is a partial cross-sectional view showing a motor-driven compressor of one embodiment.
Figure 2:
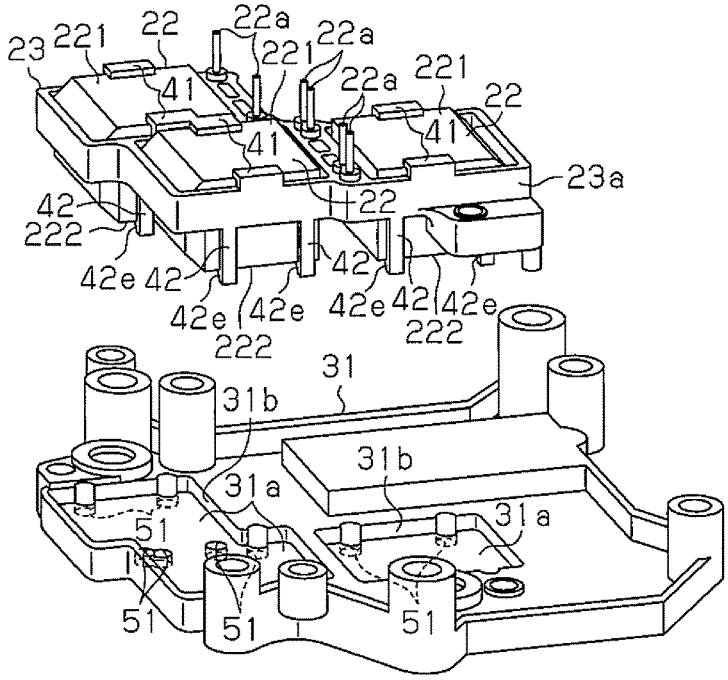
FIG. 2 is an exploded perspective view showing a coupling base and a capacitor holder holding film capacitors.
Figure 3:
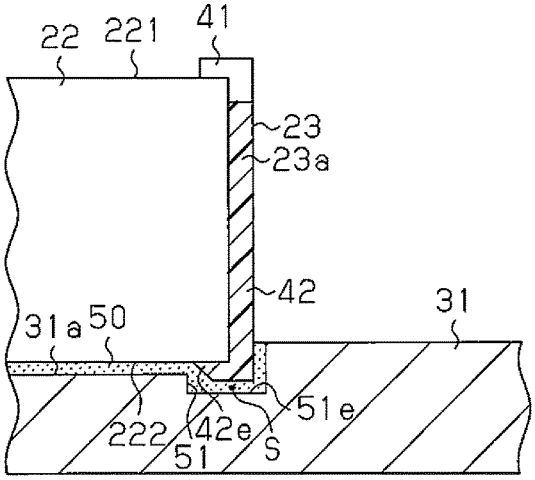
FIG. 3 is a partial cross-sectional view showing the coupling base and the capacitor holder holding the film capacitors.

Referring to FIGS. 1 to 3, one embodiment will now be described.

FIG. 1 shows a motor-driven compressor 10 installed in a vehicle. The motor-driven compressor 10 includes a housing H including a discharge housing member 11, a suction housing member 12, and a cover 13, which are made of a metal, preferably aluminum. The discharge housing member 11, the suction housing member 12, and the cover 13 are cylindrical, and each includes a closed end. The suction housing member 12 is coupled to the discharge housing member 11. The suction housing member 12 has a circumferential wall including a suction port (not shown) connected to an external refrigerant circuit (not shown). The discharge housing member 11 includes a discharge port 14 connected to the external refrigerant circuit. The suction housing member 12 accommodates a compression unit 15 (indicated by the broken lines in FIG. 1), which compresses refrigerant, and an electric motor 16, which drives the compression unit 15. Although not shown in the drawings, the compression unit 15 of the present embodiment includes a fixed scroll, which is fixed in the suction housing member 12, and a movable scroll, which is engaged with the fixed scroll.

A stator 17 is fixed to the inner surface of the suction housing member 12. The stator 17 includes a stator core 17*a*, which is fixed to the inner surface of the suction housing member 12, and coils 17*b*, which are wound around teeth (not shown) of the stator core 17*a*. A rotatable rotation shaft 19 extends through the stator 17 in the suction housing member 12. A rotor 18 is fixed to the rotation shaft 19.

The suction housing member 12 has an end wall 12*a* to which the cover 13 is coupled. A planar coupling base 31 is arranged between the suction housing member 12 and the cover 13. The coupling base 31 is made of a metal, preferably aluminum. The coupling base 31 is coupled to the end wall 12*a* of the suction housing member 12. The coupling base 31 is thermally coupled to the suction housing member 12. The coupling base 31 functions as a coupling member, which forms a portion of the housing H.

The cover 13 and the coupling base 31 define an accommodation chamber 13*a*. The accommodation chamber 13*a* accommodates a motor driving circuit 20 that drives the electric motor 16. In the present embodiment, the compression unit 15, the electric motor 16, and the motor driving circuit 20 are arranged in this order along the axis L of the rotation shaft 19 (in the axial direction).

The electric motor 16 is supplied with power that is controlled by the motor driving circuit 20. This rotates the rotor 18 and the rotation shaft 19 at a controlled rotation speed and drives the compression unit 15. The driving of the compression unit 15 draws refrigerant from the external refrigerant circuit into the suction housing member 12 through the suction port, compresses the refrigerant in the suction housing member 12 with the compression unit 15, and discharges the compressed refrigerant to the external refrigerant circuit through the discharge port 14.

The motor driving circuit 20 includes a planar circuit board 21 and various types of electric components, which are electrically connected to the circuit board 21. The circuit board 21 is arranged in the accommodation chamber 13*a* such that the axis of the rotation shaft 19 is perpendicular to the surface of the circuit board 21 on which the electric components are arranged. The motor driving circuit 20 includes a plurality of film capacitors 22. Each film capacitor 22 has a low, box-shaped profile and includes leads 22*a* that electrically connect the film capacitor 22 to the circuit board 21.

A plastic capacitor holder 23 holds the film capacitors 22. When holding the film capacitors 22, the capacitor holder 23 is coupled to the surface of the coupling base 31 that is opposite to the end wall 12*a* of the suction housing member 12.

A plurality of bosses 31*f* (only one is shown in FIG. 1) projects from the surface of the coupling base 31 that is opposite to the end wall 12*a* of the suction housing member 12. Bolts B1 are inserted through the cover 13 and fastened to the bosses 31*f* to couple the coupling base 31 to the cover 13. This joins the cover 13, the coupling base 31, and the motor driving circuit 20 and forms a module. A bolt B2 fastens the cover 13, which is joined with the coupling base 31 and the motor driving circuit 20, to the suction housing member 12.

As shown in FIG. 2, the capacitor holder 23 includes a side wall 23*a* covering the side surfaces of the film capacitors 22. Each film capacitor 22 includes a primary end surface 221, which is opposite to the coupling base 31, and a secondary end surface 222, which is opposite to the primary end surface 221. The capacitor holder 23 includes a plurality of primary retaining pieces 41 that engage the primary end surfaces 221 of the film capacitors 22. Further, the capacitor holder 23 includes a plurality of secondary retaining pieces 42 that engage the secondary end surfaces 222 of the film capacitors 22. The secondary retaining pieces 42 are elastically deformable. In the present embodiment, two primary retaining pieces 41 and four secondary retaining pieces 42 are provided for each film capacitor 22.

As shown in FIG. 3, each primary retaining piece 41 is L-shaped and extends from the side wall 23*a* of the capacitor holder 23 and away from the coupling base 31. Each secondary retaining piece 42 is L-shaped and extends from the side wall 23*a* toward the coupling base 31. Each secondary retaining piece 42 includes a hook-shaped distal end 42*e*.

As shown in FIG. 2, the surface of the coupling base 31 that faces the film capacitors 22, which is also referred to as a facing surface, includes walls 31*b*, each extending along the side surfaces of a corresponding one of the film capacitors 22, and flat coupling surfaces 31*a*, each surrounded by a corresponding one of the walls 31*b*. The surface of the coupling base 31 that faces the film capacitors 22 (including the coupling surfaces 31*a*) includes a plurality of recesses 51 extending away from the film capacitors 22. Each recess 51 receives the distal end 42*e* of a corresponding one of the secondary retaining pieces 42. Each recess 51 is partially formed in a corresponding one of the walls 31*b*.

As shown in FIG. 3, the secondary end surface 222 of each film capacitor 22 is partially overlapped with corresponding ones of the recesses 51. Each recess 51 includes a flat bottom portion 51*e*. A clearance S extends between the distal end 42*e* of the secondary retaining piece 42 and the bottom portion 51*e*. A resin material 50 is arranged between the coupling surface 31*a* and the film capacitor 22.

The operation of the present embodiment will now be described.

The resin material 50 is molten and applied to each coupling surface 31*a* before a film capacitor 22 is coupled to the coupling surface 31*a*. When coupling the film capacitor 22 to the coupling surface 31*a*, some of the molten resin material 50 applied to the coupling surfaces 31*a*, that is, surplus molten resin material 50 that cannot be accommodated between the film capacitor 22 and the coupling surface 31*a*, enters the recesses 51. Thus, compared to a structure that does not have the recesses 51 in the coupling base 31, the present embodiment limits transfer of the resin material 50 from between the film capacitor 22 and the coupling surface 31*a* toward portions of the film capacitor 22 other than the secondary end surface 222. Thus, the resin material 50 does not adhere to the leads 22*a*. This limits defects such as current leakage that would occur if the resin material 50 were to adhere the leads 22*a*.

When fitting each film capacitor 22 into the capacitor holder 23, the corresponding secondary retaining pieces 42 are pressed by the film capacitor 22 and elastically deformed. This allows the film capacitor 22 to be easily fitted to the capacitor holder 23. When the film capacitor 22 is arranged at the inner side of the side wall 23*a* in the capacitor holder 23, the primary retaining pieces 41 engage the primary end surface 221 of the film capacitor 22. Further, the secondary retaining pieces 42 return to their original positions so that the distal ends 42*e* of the secondary retaining pieces 42 engage the secondary end surface 222 of the film capacitor 22. This fixes the film capacitor 22 to the capacitor holder 23.

In addition, the resin material 50 that enters the recess 51 fixes the secondary retaining piece 42 to the coupling base 31. Thus, the coupling of the capacitor holder 23 and the coupling base 31 is reinforced. This increases the vibration resistance of the film capacitors 22 that are held by the capacitor holder 23.

The advantages of the present embodiment will now be described.

(1) The facing surface of the coupling base 31 that faces the film capacitors 22 includes the recesses 51. The recesses 51 each extend away from the film capacitors 22 and receive some of the resin material 50. When coupling the film capacitors 22 to the coupling surfaces 31*a*, some of the molten resin material 50 applied to the coupling base 31 enters the recesses 51. Thus, compared to a structure that does not have the recesses 51 in the coupling base 31, the present embodiment limits transfer of the resin material 50 out of the space between the film capacitors 22 and the coupling base 31.

(2) The capacitor holder 23 holds the film capacitors 22. The capacitor holder 23 includes the side wall 23*a*, which covers the side surfaces of the film capacitors 22, and the secondary retaining pieces 42, which engage the secondary end surfaces 222 of the film capacitors 22. The secondary retaining pieces 42 are inserted into the recesses 51. Accordingly, the side wall 23*a* of the capacitor holder 23 and the secondary retaining pieces 42 hold the film capacitors 22. The resin material 50 that enters the recesses 51 fixes the secondary retaining pieces 42 to the coupling base 31. This reinforces the coupling of the capacitor holder 23 and the coupling base 31. Thus, the film capacitors 22 held by the capacitor holder 23 have improved vibration resistance.

(3) Each recess 51 includes the bottom portion 51*e*. The clearance S extends between the secondary retaining piece 42 and the bottom portion 51*e*. This allows surplus resin material 50 to enter the recess 51.

(4) The capacitor holder 23 includes the secondary retaining pieces 42. The coupling base 31 includes the recesses 55 that are arranged in correspondence with the secondary retaining pieces 42. Thus, the secondary retaining pieces 42 ensure that the film capacitors 22 are held by the capacitor holder 23. In addition, the resin material 50 that enters each recess 51 fixes the corresponding secondary retaining piece 42 to the coupling base 31. This further reinforces the coupling of the capacitor holder 23 to the coupling base 31.

(5) The secondary end surface 222 of each film capacitor 22 that faces the coupling base 31 is partially overlapped with the corresponding recesses 51. This allows the motor driving circuit 20 to be reduced in size compared to when the secondary end surface 222 does not overlap with the recesses 51. In addition, each secondary retaining piece 42 is partially arranged on the secondary end surface 222, which overlaps with the recesses 51. This reduces the size of the motor driving circuit 20 while ensuring the holding of the film capacitors 22.

(6) The facing surface of the coupling base 31 includes the walls 31*b* each extending along the side surfaces of the corresponding film capacitor 22. The walls 31*b* facilitate the positioning of the film capacitors 22 relative to the coupling base 31.

(7) The recesses 51 are partially formed in the walls 31*b*. That is, the walls 31*b* include the recesses 51. This limits transfer of the resin material 50 out of the space between the film capacitors 22 and the coupling base 31. In addition, surplus resin material 50 enters the space between the wall 31*b* and the secondary retaining piece 42. Thus, the surplus resin material 50 further rigidly fixes the secondary retaining piece 42 to the coupling base 31. This further reinforces the coupling of the capacitor holder 23 and the coupling base 31.

(8) The secondary retaining pieces 42 are elastically deformable. When inserting each film capacitor 22 into the capacitor holder 23, the corresponding secondary retaining pieces 42 are pressed by the film capacitor 22 and elastically deformed. This facilitates the insertion of the film capacitor 22 into the capacitor holder 23.

(9) The secondary retaining pieces 42 are elastically deformable and thus less rigid than the primary retaining pieces 41. Accordingly, each secondary retaining piece 42 retains the corresponding film capacitor 22 with less force than the primary retaining piece 41. Thus, in the present embodiment, four secondary retaining pieces 42 are provided for each film capacitor 22. This increases the area and the number of locations of the secondary end surface 222 of each film capacitor 22 that are held by the secondary retaining pieces 42. Thus, the film capacitor 22 is retained with sufficient force.

It should be apparent to those skilled in the art that the present invention may be embodied in many other specific forms without departing from the spirit or scope of the invention. Particularly, it should be understood that the present invention may be embodied in the following forms.

Figure 4:
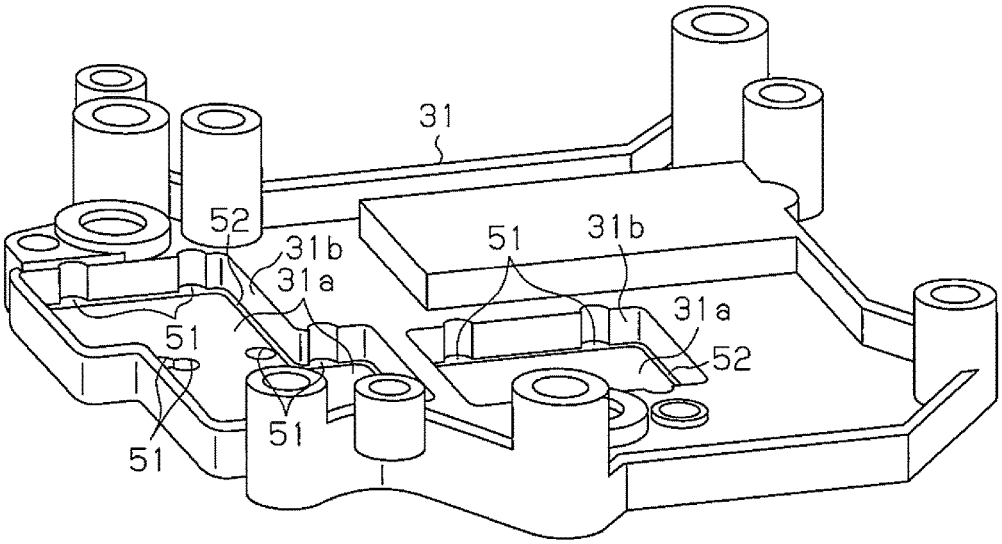
FIG. 4 is a perspective view showing a coupling base in another embodiment.

As shown in FIG. 4, the coupling base 31 may include looped grooves 52, which function as recesses surrounding the coupling surfaces 31*a*. In this case, when coupling a film capacitor 22 to a coupling surface 31*a*, some of the resin material 50 applied to the coupling surface 31*a* in advance enters the corresponding groove 52 in addition to the recesses 51. This further limits transfer of resin material 50 forced out from between the film capacitor 22 and the coupling surface 31*a* toward portions of the film capacitor 22 other than the secondary end surface 222. In addition, the grooves 52 further facilitate the accommodation of the surplus resin material 50.

Figure 5:
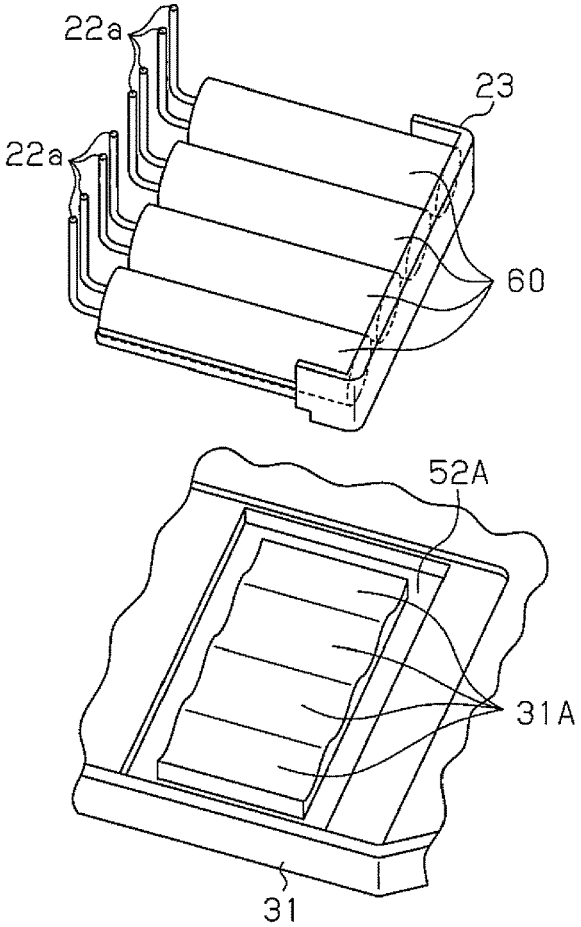
FIG. 5 is an exploded perspective view showing electrolytic capacitors and a coupling base in a further embodiment.

As shown in FIG. 5, electrolytic capacitors 60 may be used as capacitors. In this case, the coupling base 31 has coupling surfaces 31A to which the electrolytic capacitors 60 are coupled. Each coupling surface 31A is curved inward. The coupling base 31 also includes a looped groove 52A extending away from the electrolytic capacitors 60. The groove 52A surrounds the coupling surfaces 31A.

Figure 6:
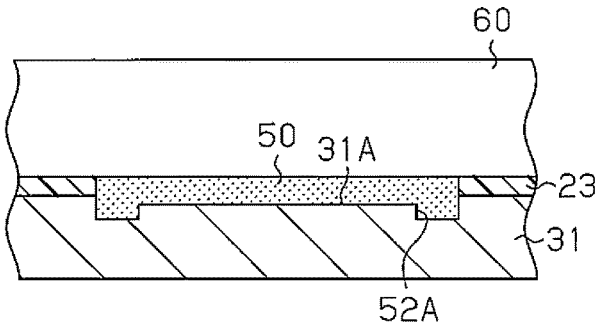
FIG. 6 is a partial cross-sectional view showing the electrolytic capacitor and the coupling base of FIG. 5.

As shown in FIG. 6, each electrolytic capacitor 60 is coupled to the corresponding coupling surface 31A to which the resin material 50 has been applied in advance. When coupling the electrolytic capacitor 60 to the coupling surface 31A, some of the resin material 50 on the coupling surface 31A enters the groove 52A. This limits transfer of resin material 50 forced out from between the electrolytic capacitor 60 and the coupling surface 31A toward portions of the electrolytic capacitor 60 that do not face the coupling surface 31A.

The coupling base 31 may be omitted. Instead, the film capacitors 22 may be coupled to the end wall 12*a* of the suction housing member 12. In this case, the end wall 12*a* of the suction housing member 12 functions as a coupling member to which the film capacitors 22 are coupled. Further, the surface of the end wall 12*a* that faces the film capacitors 22 includes recesses extending away from the film capacitors 22.

There is no limitation to the number of the primary retaining pieces 41 and the number of the secondary retaining pieces 42.

The number of the recesses 51 is not limited. For example, the coupling base 31 may include recesses other than the recesses 51 that receive the secondary retaining pieces 42.

The number of the film capacitors 22 is not limited.

The motor driving circuit 20 may be located radially outward of the rotation shaft 19.

The compression unit 15 may be of a piston type or a vane type.

The present examples and embodiments are to be considered as illustrative and not restrictive and the invention is not to be limited to the details given herein, but may be modified within the scope and equivalence of the appended claims.

The invention claimed is:

1. A motor-driven compressor comprising:

a compression unit adapted to compress refrigerant;

an electric motor adapted to drive the compression unit;

a housing that accommodates the compression unit and the electric motor, wherein the housing includes a coupling member;

a motor driving circuit adapted to drive the electric motor, wherein the motor driving circuit includes a circuit board and a capacitor, which is electrically connected to the circuit board, and the capacitor includes a side surface and an end surface that faces a coupling surface of the coupling member;

a resin material located between the coupling surface of the coupling member and the end surface of the capacitor, wherein the coupling surface includes a recess extending away from the end surface of the capacitor, and the recess receives some of the resin material; and a capacitor holder that holds the capacitor and is coupled to the coupling member, wherein the capacitor holder includes:

a side wall covering the side surface of the capacitor, and an elastically-deformable retaining piece that extends from the side wall covering the side surface of the capacitor toward the coupling member along the side surface of the capacitor, wherein the retaining piece includes a distal end that projects toward the recess beyond the end surface of the capacitor and engages the end surface of the capacitor, wherein the distal end of the retaining piece is inserted into the recess and the resin material.

2. The motor-driven compressor according to claim 1, wherein the recess includes a bottom portion, and a clearance extends between the bottom portion and the distal end of the elastically-deformable retaining piece.

3. The motor-driven compressor according to claim 1, wherein the elastically-deformable retaining piece is one of a plurality of elastically-deformable retaining pieces, and the recess is one of a plurality of recesses arranged in correspondence with the elastically-deformable retaining pieces.

4. The motor-driven compressor according to claim 1, wherein the end surface of the capacitor is partially overlapped with the recess.

5. The motor-driven compressor according to claim 1, wherein the coupling member includes a wall facing the side surface of the capacitor and extending along the side surface of the capacitor.

6. The motor-driven compressor according to claim 5, wherein the recess is partially formed in the wall.

7. The motor-driven compressor according to claim 1, wherein the recess is a looped groove.

8. The motor-driven compressor according to claim 1, wherein the capacitor includes a film capacitor.

9. The motor-driven compressor according to claim 1, further comprising a rotation shaft that is accommodated in the housing and rotated integrally with a rotor of the electric motor, wherein the compression unit, the electric motor, and the motor driving circuit are arranged in this order along an axis of the rotation shaft.

10. The motor-driven compressor according to claim 1, wherein the motor-driven compressor is installed in a vehicle.

11. The motor-driven compressor according to claim 1, wherein the capacitor has a cuboid shape including four side surfaces, the side wall of the capacitor holder includes wall portions, which surround the four side surfaces of the capacitor, and the elastically-deformable retaining piece extends from each of two of the wall portions that face each other.

* * * * *